US006168554B1

(12) United States Patent
Berg et al.

(10) Patent No.: US 6,168,554 B1
(45) Date of Patent: Jan. 2, 2001

(54) EXERCISE ATTACHMENT FOR CROSS COUNTRY SKI SIMULATOR

(76) Inventors: Steve W. Berg, 605 N. Second, Villa Park, IL (US) 60181; Ralph Swanson, 9 S. 322 Florence Ave., Downers Grove, IL (US) 60516

( * ) Notice: Under 35 U.S.C. 154(b), the term of this patent shall be extended for 0 days.

(21) Appl. No.: 08/997,286

(22) Filed: Dec. 23, 1997

(51) Int. Cl.[7] ..... A63B 22/00
(52) U.S. Cl. ..... 482/70; 482/72; 482/138
(58) Field of Search ..... 482/51, 70, 71, 482/72, 73, 112, 114, 116, 118, 121, 122, 130, 138, 908

(56) References Cited

U.S. PATENT DOCUMENTS 4,023,795 * 5/1977 Pauls ..... 272/97
4,651,942 * 3/1987 Walden ..... 272/135
4,900,013 * 2/1990 Rodgers, Jr. ..... 272/70

* cited by examiner

*Primary Examiner*—Stephen R. Crow
*Assistant Examiner*—T. Nguyen
(74) *Attorney, Agent, or Firm*—Robert L. Marsh

(57) ABSTRACT

An attachment is provided for interchangeably converting a ski simulating machine into a rowing machine, the ski simulating machine having a frame, a pair of skis slidably mounted on the frame to move in forward and rearward directions on the frame and means mounted on the frame for providing resistance to the pair of skis during at least one of forward and rearward movement. The attachment includes a seat mounted for guided sliding movement with respect to the frame, foot support means mounted on the frame for bracing a user's feet when the user is sitting on the seat, and means for coupling the resistance providing means for application to a user's arm movement during a rowing exercise.

12 Claims, 10 Drawing Sheets

EXERCISE ATTACHMENT FOR CROSS COUNTRY SKI SIMULATOR

FIELD OF THE INVENTION

The present invention is directed toward an exercise apparatus and, more particularly, toward an exercise apparatus useable in a plurality of configurations.

BACKGROUND OF THE INVENTION

In today's health conscious world, people are realizing the benefits of a regular cardiovascular exercise program. As a result, numerous exercising apparatus or machines have been developed enabling a user to execute a variety of body exercising movements in opposition to a resistance. One such type of exercise device which has become popular is a cross-country ski simulator, with NORDICTRACK® models sold by NordicTrack, Inc. being very popular.

Such cross-country ski simulators include a pair of skis slidably mounted on a frame for movement in forward and rearward directions, with resistance, in opposite synchronization to simulate cross-country skiing. This resistance may be in the form of a flywheel device activated by rearward movement of the skis. These machines are generally combined with an arm exerciser in the form of a reciprocating cable extending around a pulley which resists turning. The user grasps and pulls on the opposite ends of the cable as he/she skis. This pulley may resist turning through the motion of an additional flywheel device activated by the cable.

While the cross-country ski simulating exercise aids in improving a user's overall health, a user is apt to get bored performing the same exercise movements over and over again. Further, by performing the same exercise movements over and over, only select groups of muscles are being worked, possibly to the detriment and/or exclusion of other muscles and/or muscle groups.

A user wishing to be able to perform a variety of exercise movements may have to purchase a different machine for each exercise movement. Such purchases may add up quickly. Further, a user may simply not have enough space in his/her house to accommodate a plurality of exercise machines.

Accordingly, it is desirable to provide a multi-purpose exercise machine which may be reconfigured or reoriented so that the user may perform a plurality of exercises, including rowing and cross-country skiing exercises.

SUMMARY OF THE INVENTION

An attachment, according to a first embodiment of the present invention, is provided for interchangeably converting a ski simulating machine into a rowing machine. The ski simulating machine includes a frame, a pair of skis mounted on the frame to move in forward and rearward directions on the frame, and means mounted on the frame for providing resistance to the pair of skis during at least one of forward and rearward movement. The attachment includes a seat slidably mounted on the skis for guided sliding movement with respect to the skis, foot support means mounted on the frame for bracing a user's feet when the user is sitting on the seat, and a pair of rowing oars each having a lower end pivotally mounted on a corresponding one of the skis.

In one aspect of the first embodiment of the present invention, a track is mounted on each of the skis for movement therewith, and means are provided for operatively mounting the seat on the track for guided sliding movement with respect to the track.

In another aspect of the first embodiment of the present invention, the mounting means includes a pair of rollers attached to the seat engaging each of the tracks.

In another aspect of the first embodiment of the present invention, the foot support means is pivotally mountable on the frame.

In another aspect of the first embodiment of the present invention, the foot support means is mountable on the skis for bracing a user's feet when the user is using the ski simulating machine to simulate skiing.

An attachment, according to a second embodiment of the present invention, is provided for interchangeably converting a ski simulating machine into a rowing machine. The ski simulating machine includes a frame, a pair of skis slidably mounted on the frame to move in forward and rearward directions on the frame, and means mounted on the frame for providing resistance to the pair of skis during at least one of forward and rearward movement. The attachment includes a seat mounted for guided sliding movement with respect to the frame, foot support means mounted on the frame for bracing a user's feet when the user is sitting on the seat, and means for coupling the resistance providing means for application to a user's arm movement during a rowing exercise.

In one aspect of the second embodiment of the present invention, the resistance providing means includes a one-way clutch flywheel rotatably mounted on the frame and a pair of oppositely disposed rollers keyed for rotation with the flywheel. The oppositely disposed rollers frictionally engage the skis and provide resistance associated with the one-way clutch flywheel to the pair of skis during at least one of forward and a rearward movement.

In another aspect of the second embodiment of the present invention, the coupling means includes a first rotatable spool mounted on the frame, the first rotatable spool having a first position wherein the first rotatable spool frictionally engages one of the oppositely disposed rollers, and a second disengaged position, a first pulley having its rotational axis translatable relative to the frame, a second pulley having its rotational axis fixed relative to the frame, first means for biasing translational movement of the rotational axis of the first pulley relative to the frame, and a first cable having distal ends, the first cable having one of the distal ends attached to the frame through the first rotatable spool and extending to a handle at the other distal end graspable by a user while sitting in the seat. The first rotatable spool, first pulley, second pulley and first means cooperating with the first cable to couple the resistance providing means for application to a user's arm movement during a rowing exercise with the first rotatable spool in its first position.

In another aspect of the second embodiment of the present invention, the first means includes a first tension spring coupled between the first pulley and the frame.

In another aspect of the second embodiment of the present invention, the coupling means further includes a second rotatable spool mounted on the frame, the second rotatable spool having a first position wherein the second rotatable spool frictionally engages the other of the oppositely disposed rollers, and a second disengaged position, a third pulley having its rotational axis translatable relative to the frame, a fourth pulley having its rotational axis fixed relative to the frame, second means for biasing translational movement of the rotational axis of the third pulley relative to the frame, and a second cable having distal ends, the second cable having one of its distal ends attached to the frame through the second rotatable spool and extending to a handle at the other distal end graspable by a user while sitting in the seat. The second rotatable spool, third pulley, fourth pulley and second means cooperating with the second cable to couple the resistance providing means for application to a user's arm movement during a rowing exercise with the second rotatable spool in its first position.

In another aspect of the second embodiment of the present invention, the second means includes a second tension spring coupled between the third pulley and the frame.

An attachment, according to a third embodiment of the present invention, is provided for interchangeably converting a ski simulating machine into a rowing machine. The ski simulating machine includes a frame, a pair of skis mounted on the frame to move in forward and rearward directions, first means on the frame for providing resistance to the pair of skis during at least one of forward and rearward movement, and second means mounted on the frame for providing resistance to user's arm movement. The attachment includes a seat mounted on the skis for movement therewith, and foot support means mounted on the frame for bracing a user's feet when the user is sitting on the seat.

In one aspect of the third embodiment of the present invention, a coupling device is provided cooperating with the second means for providing resistance to a user's arm movement during use of the ski simulating machine as a rowing machine.

In another aspect of the third embodiment of the present invention, the second means includes a tension adjustable pulley cooperating with a cable having distal ends. The coupling device includes third means for operatively securing one of the distal ends of the cable to the frame, and a cable extender attached to the other distal end of the cable extending to a handle graspable and movable by a user sitting on the seat during a rowing exercise.

In another aspect of the third embodiment of the present invention, the third means includes fourth means for biasing the one distal end of the cable against translational movement relative to the frame.

In another aspect of the third embodiment of the present invention, the fourth means includes a constant spring force assembly coupled between the one distal end of the cable and the frame.

In another aspect of the third embodiment of the present invention, the constant spring force assembly includes a tension spring.

In another aspect of the third embodiment of the present invention, the second means includes a tension adjustable pulley cooperating with a cable having distal ends with one of the distal ends extending to handle graspable and movable by a user sitting on the seat during a rowing exercise. The coupling device includes a pulley having its rotational axis translatable relative to the frame, third means coupled between the pulley and frame for biasing translational movement of the rotational axis of the pulley relative to the frame, and a cable extender extending from the other distal end of the cable to the pulley, and from the pulley to the frame. The pulley and third means cooperating with the cable extender to provide resistance to a user's arm movement during a rowing exercise.

In another aspect of the third embodiment of the present invention, the third means includes a tension spring.

In another aspect of the third embodiment of the present invention, the second means includes a tension adjustable pulley cooperating with a cable having distal ends with one of the distal ends extending to a handle graspable and movable by a user sitting on the seat during a rowing exercise. The coupling device includes a first pulley having its rotational axis fixed relative to the frame, a second pulley having its rotational axis translatable relative to the frame, third means coupled between the second pulley and frame for biasing translational movement of the rotational axis of the second pulley relative to the frame, and a cable extender extending from the other distal end of the cable to one of the frame and the third means. The first pulley, second pulley and third means cooperating with the cable extender to provider resistance to a user's arm movement during a rowing exercise.

In another aspect of the third embodiment of the present invention, the cable extender extends from the other distal end of the cable to the second pulley, from the second pulley to the first pulley, and from the first pulley to one of the frame and third means.

In another aspect of the third embodiment of the present invention, the third means includes a tension spring.

DETAILED DESCRIPTION OF THE PREFERRED EMBODIMENTS

Figure 1:
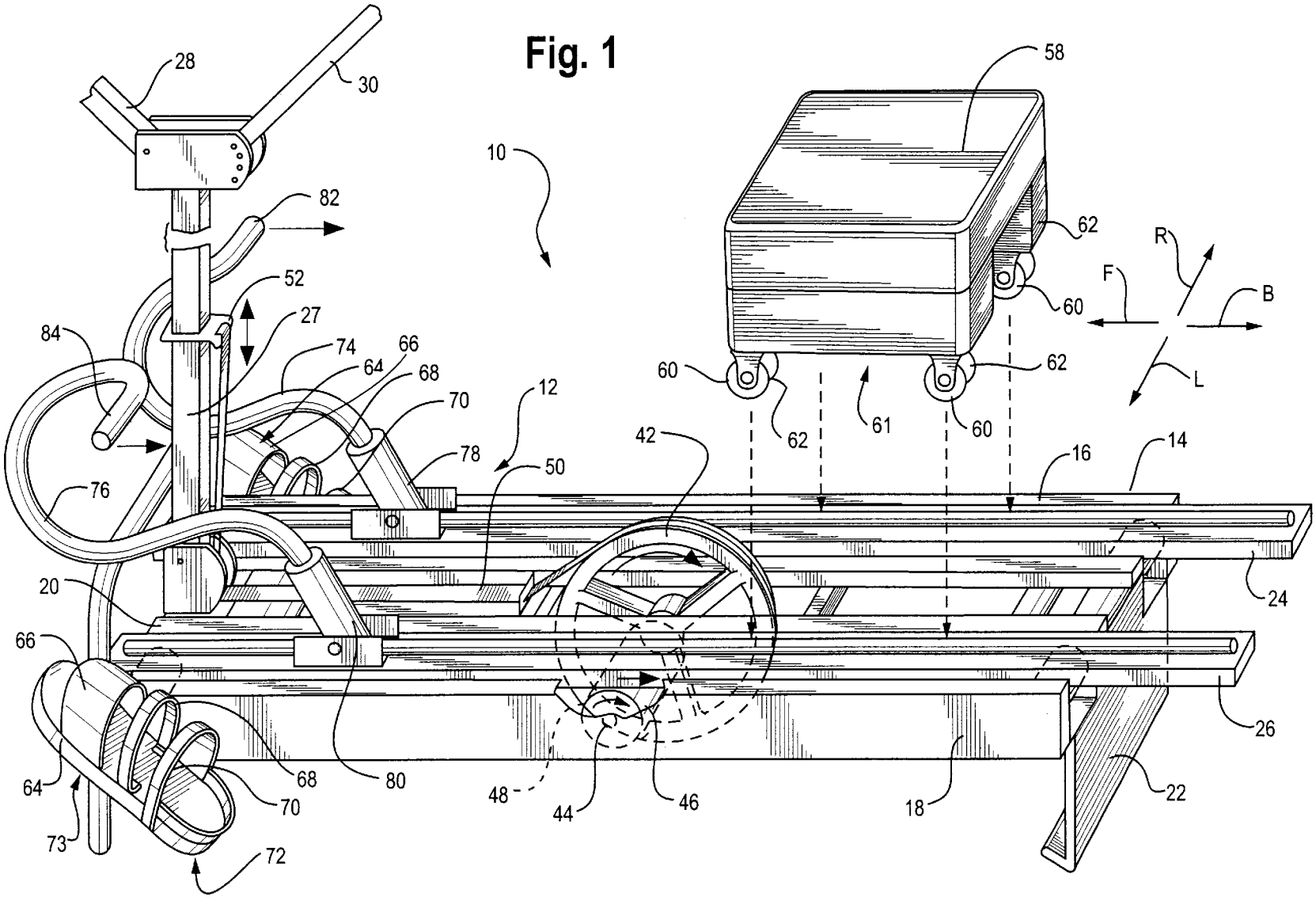
FIG. 1 is a perspective view of an attachment to a cross-country ski simulator according to a first embodiment of the present invention.

FIG. 1 illustrates an exercise apparatus 10 according to a first embodiment of the present invention, which includes a prior art NORDIC-TRACK® cross-country ski simulator 12 with the attachments associated with the present invention mounted thereon. The simulator 12 includes a frame 14 having side members 16,18 and front and rear members 20,22. A pair of skis 24,26 are slidably mounted on the frame and slidable in longitudinal forward and rearward or backward directions F,B, and are laterally spaced in left and right lateral directions L,R. The simulator 12 includes a vertical post 27, a pivotable post 28 and a swing up rod assembly 30, the swing up rod assembly 30 generally extending forwardly and pivotable between upright and downward inclines. A cable 32 (see FIG. 8) is wrapped about a drum pulley 34 at the top of the pivotable post 28 (see FIG. 8, where pivotable post 28 is moved to a vertical position) so that a user can grasp handles 36,31 located at the distal ends of the cable 32 (see FIG. 8) and pull on the distal ends of the cable 32 as the user moves the skis 24,26 forward and backward against resistance. The resistance of the drum pulley 34 can be adjusted via a tension adjust knob 38 (see FIG. 8). A cushion 40 (see FIG. 8) is provided at the end of the swing up rod assembly 30 so that a user may rest his/her pelvis area against the cushion when performing a simulated cross-country skiing exercise.

Referring back to FIG. 1, the resistance applied to the skis 24,26 as they move in forward and backward directions is associated with a one-way clutch flywheel 42 rotatably mounted to the frame 14. The flywheel 42 includes a pair of oppositely displaced rollers 44,45 (roller 45 shown in FIG. 7) disposed on opposite sides of the flywheel 42 and keyed for rotation therewith. The rollers 44,45 include friction engaging surfaces 46,47 which contact the bottom surfaces of the skis 24,26. Movement of the skis 24,26 in a backward direction effectuates rotation of the rollers 44,45 in a direction as indicated by arrows 48,49. Since the rollers 44,45 are keyed to the flywheel 42, rotation of the rollers 44,45 in the direction shown by arrows 48,49 effectuates rotation of the flywheel 42 in the same direction, thus providing conventional resistance to the skis 24,26 as they move in the rearward direction. The resistance associated with the flywheel 42 may be varied by adjusting the tension of the strap 50 which wraps around the flywheel 42 via adjustment mechanism 52 disposed on the vertical post 27.

It should be noted that the skis 24,26 are generally free to move in the forward direction without the resistance associated with the flywheel 42 impeding movement, as is generally the case in cross-country skiing.

Figure 2:
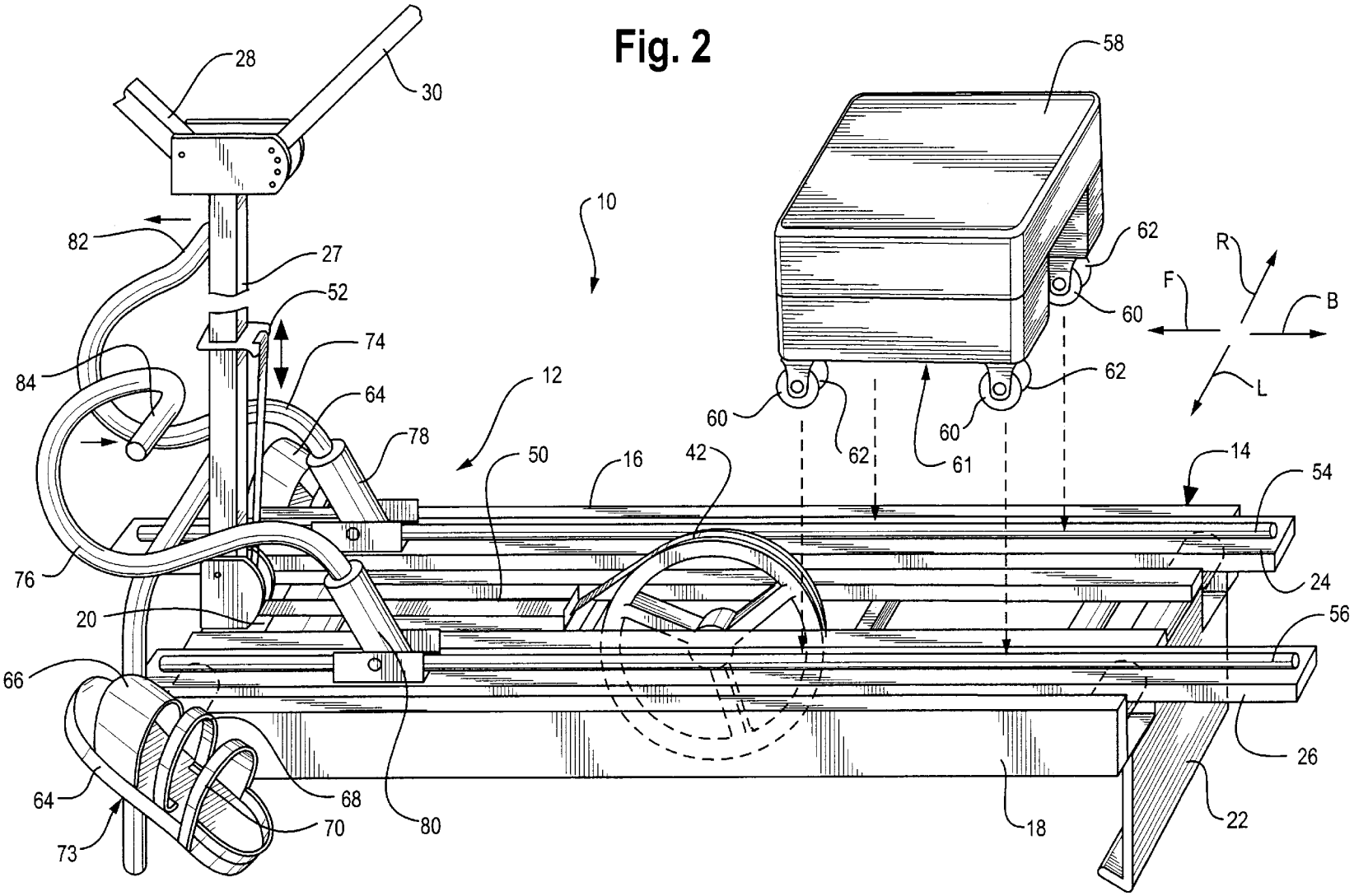
FIG. 2 is a perspective view of the attachment as shown in FIG. 1, depicting reciprocating movement of the skis.

The attachment according to the first embodiment of the present invention to convert the above-described cross-country ski simulating machine 12 interchangeably into a rowing machine is shown in FIGS. 1–2. The attachment includes a pair of tracks or rods 54,56 mounted by any conventionally well recognized means not disclosed herein on the skis 24,26 for movement therewith. A seat 58 is provided which includes rollers 60 mounted on the bottom surface 61 thereof. The rollers 60 include concave roller surfaces 62 which engage the tracks 54,56 so that the seat 58 is free to slidably movable forward and backward directions on the tracks 54,56.

A pair of foot supports 64 are pivotally mounted to the frame 14 at the side members 16,18. The foot supports 64 include straps 66, 68 and 70 for bracing the feet of a user while the user is sitting in the seat 58. The foot supports 64 further include a longitudinal channel 72 extending along the bottom surface 73 of the foot support 64 from heal to toe. The foot supports 64 are mountable to the skis 24,26 should the user wish to utilize the exercise apparatus 10 to simulate cross-country skiing. When attached to the skis 24,26, the tracks 54,56 are received in the channel 72 and the straps 68,70 are removable from the foot supports 64 so that the desired foot movements associated with cross-country skiing can be achieved.

A pair of rowing oars 74,76 are pivotally attached to the skis 24,26 at their lower ends 78,80. The rowing oars 74,76 include handle areas 82,84 at their other end, the handle areas 82,84 being graspable by a user to perform a rowing exercise when sitting in the seat 58. While the rowing oars 74,76 are shown in FIGS. 1–2 as pivotally attached to the skis 24,26, non-pivotal attachment of the rowing oars 74,76 to the skis 24,26 is also contemplated.

In operation, a user sits in the seat 58 and places his/her feet in the foot supports 64. The user then grasps the handle areas 82,84 of the rowing oars 74,76 and effectuates a rowing motion, either moving the oars 74,76 in the same direction as shown in FIG. 1, or effectuating reciprocating movement of the rowing oars 74,76 as shown in FIG. 2. Movement of the oars 74,76 effectuates movement of the skis 24,26, which in turn couples the resistance associated with the flywheel 42 to a user's arm movement during a rowing exercise.

Figure 3:
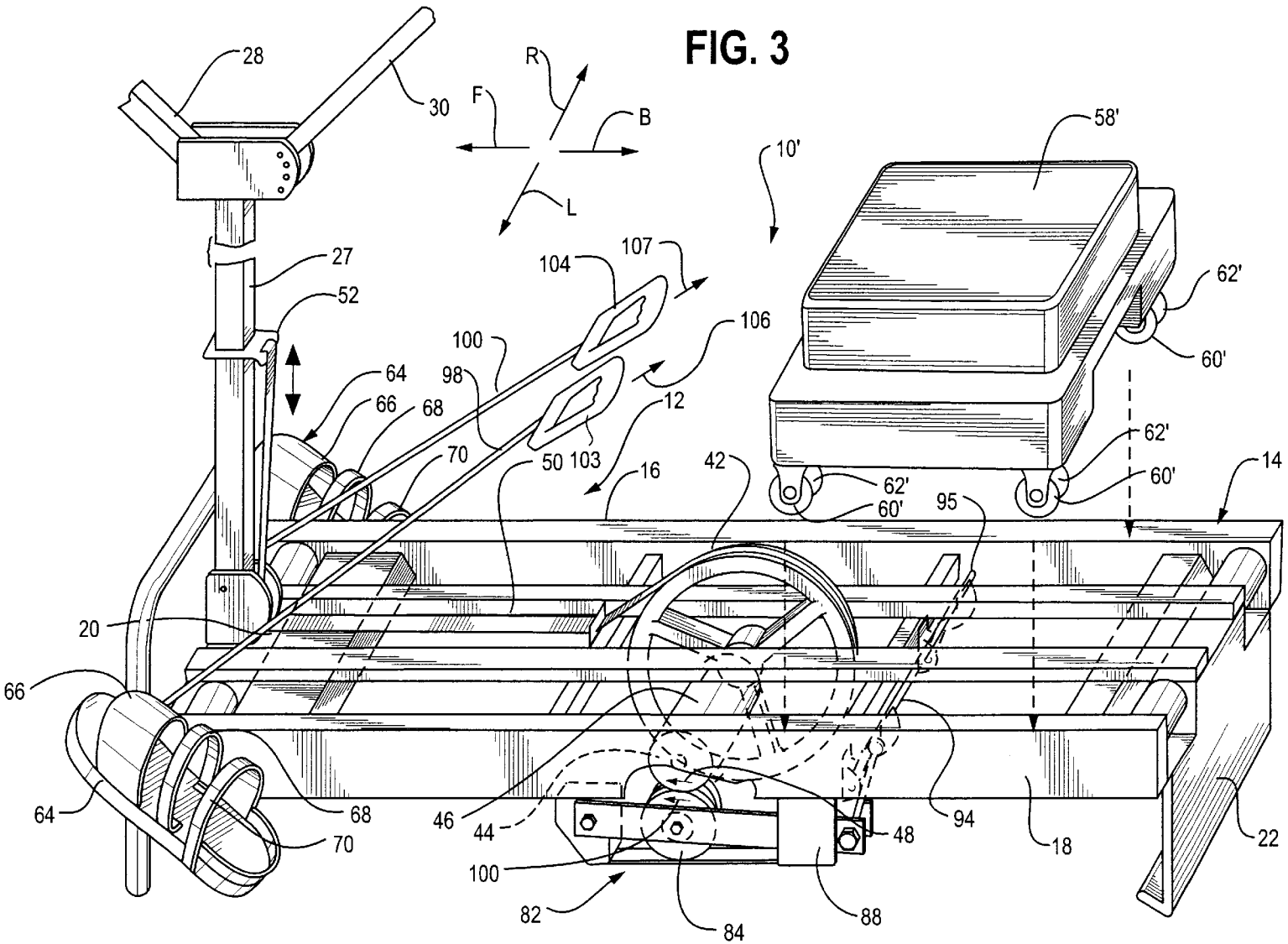
FIG. 3 is a perspective view of the attachment according to a second embodiment of the present invention, including a coupling device for coupling the resistance normally associated with the skis during a cross-country skiing movement to a user's arms during a rowing exercise.

A second embodiment of the present invention is depicted generally at 10' in FIG. 3 with like elements indicated with the same reference numbers and elements requiring slight modification indicated with a prime (')). As shown in FIG. 3, the skis 24,26 have been removed and the seat 58' is slidable on the frame via rollers 60' attached to the bottom surface 61' of the seat 58', the rollers 60' including rolling surfaces 62' adapted for rolling movement along side members 16,18. It should be noted, however, that the skis 24,26 could have been left mounted on the frame 14, and the seat 58 with rollers 60 could have been utilized in the second embodiment of the present invention as shown in FIG. 3.

Coupling devices, shown generally at 82,83 (coupling device 83 shown in FIG. 4), are provided for coupling the resistance associated with the flywheel 42 to a user's arm movement during a rowing exercise. With respect to FIGS. 3–6, coupling devices 82,83 each include a spool 84,86 rotatably mounted to a respective frame 88,90, with the frames 88,90 conventionally attached to the frame 14 and pivotable about an axis 92.

Figure 4:
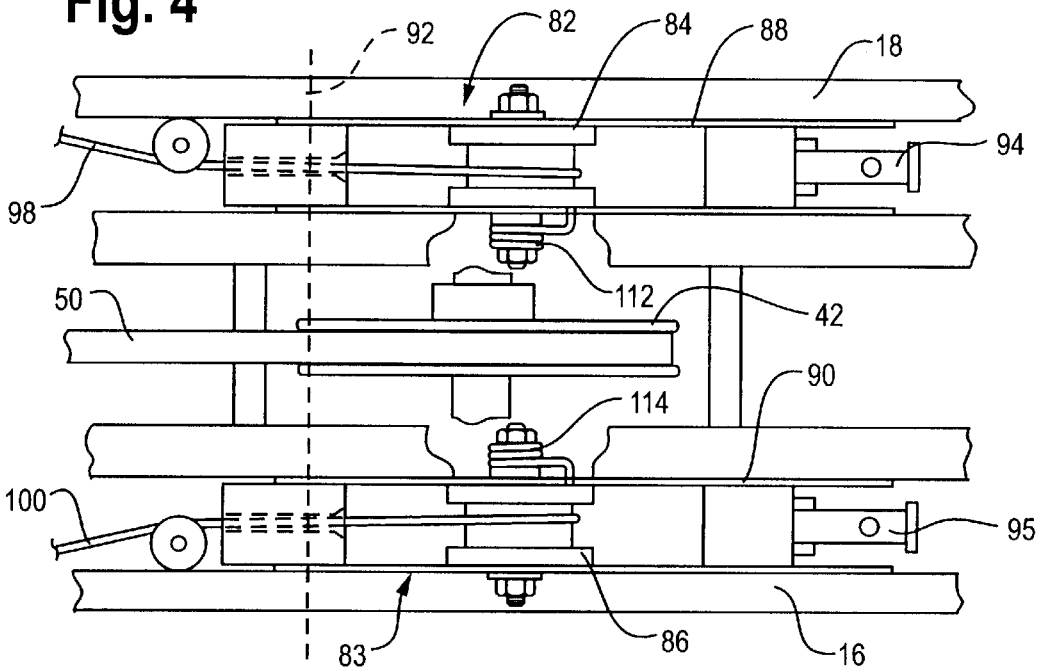
FIG. 4 is a bottom view of the coupling device according to the present invention.
Figure 5:
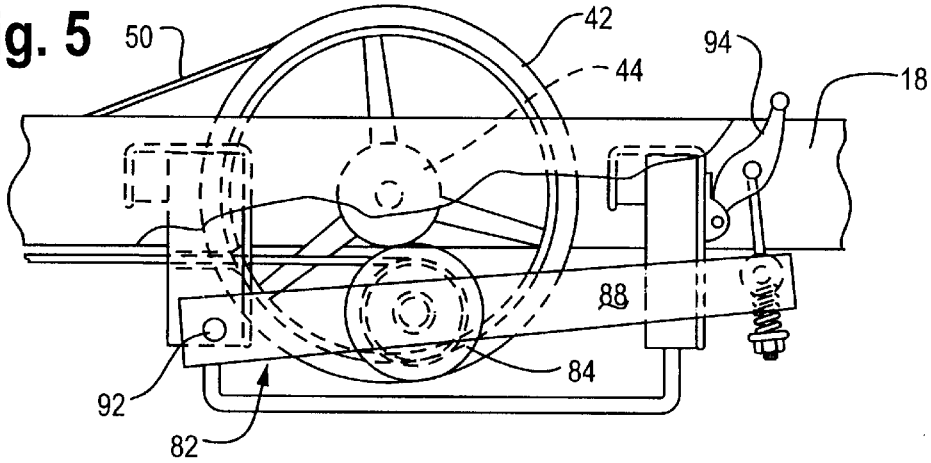
FIG. 5 is a side view of the coupling device in its first engaged position.
Figure 6:
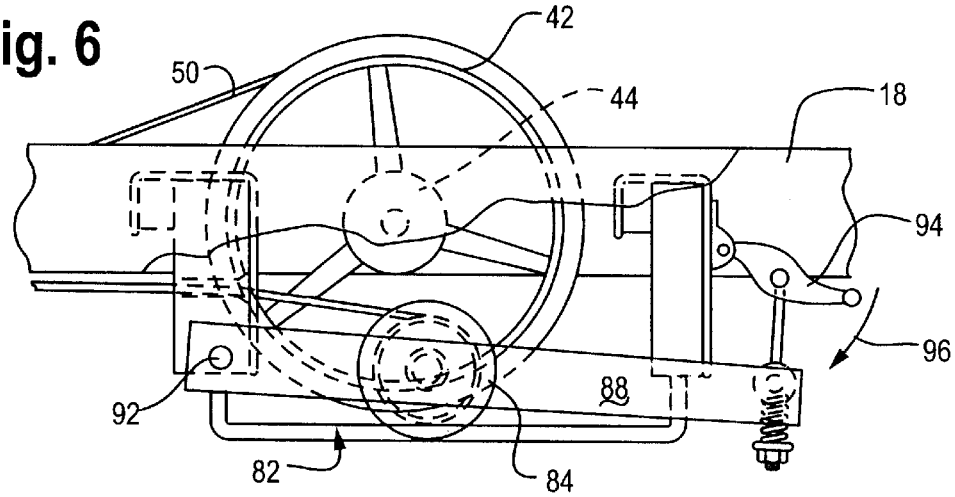
FIG. 6 is a side view of the coupling device in its second disengaged position.

As shown more particularly with respect to FIGS. 5–6, spools 84,86 may be repositioned into and out of engagement with the oppositely disposed rollers 44,45 (roller 45 shown in FIG. 7) keyed to the flywheel 42. This repositioning is accomplished by pivoting the frame members 88,90, along with the spools 84,86, via levers 94,95 as shown in FIGS. 3–6.

With reference to FIG. 5, the coupling device 82 is shown in a first position with the spool 84 engaging the roller 44. By pivoting the lever 94 in a downward direction, as indicated by arrow 96 in FIG. 6, the coupling device 82 is pivoted about axis 92 such that the spool 84 is moved out of engagement with the roller 44 as shown in FIG. 6. It should be understood that the coupling device 83 is repositionable in the same manner as coupling device 82.

Referring now to FIGS. 3–4, cables 98,100 are wrapped around each spool 84,86 and extend around pulleys 101,102 (see FIG. 7) at the front member 20 to handles 103,104 graspable by a user. With the coupling devices 82,83 in their first position as shown in FIGS. 3 and 5, operation is as follows.

A user sits in the seat 58' and places his/her feet in the foot supports 64. The user grasps the handles 103,104 and pulls them in the direction indicated by arrows 106,107 to effectuate a rowing movement. Pulling the handles 103,104 in such a manner causes spools 84,86 to rotate in the direction indicated by arrows 108,109 (see also FIG. 7), which due to the frictional engagement between the spools 84,86 and rollers 44,45, causes rollers 44,45 to rotate in the direction as indicated by arrows 48,49 (see also FIG. 7). As a result, the resistance associated with the flywheel 42 is applied to a user's arm movement during a rowing exercise via the handles 103,104, cables 98,100, spools 84,86 and rollers 44,45. Cables 98,100 are retracted back around the spools 84,86 via return springs 112,114 (see FIG. 4).

Figure 7:
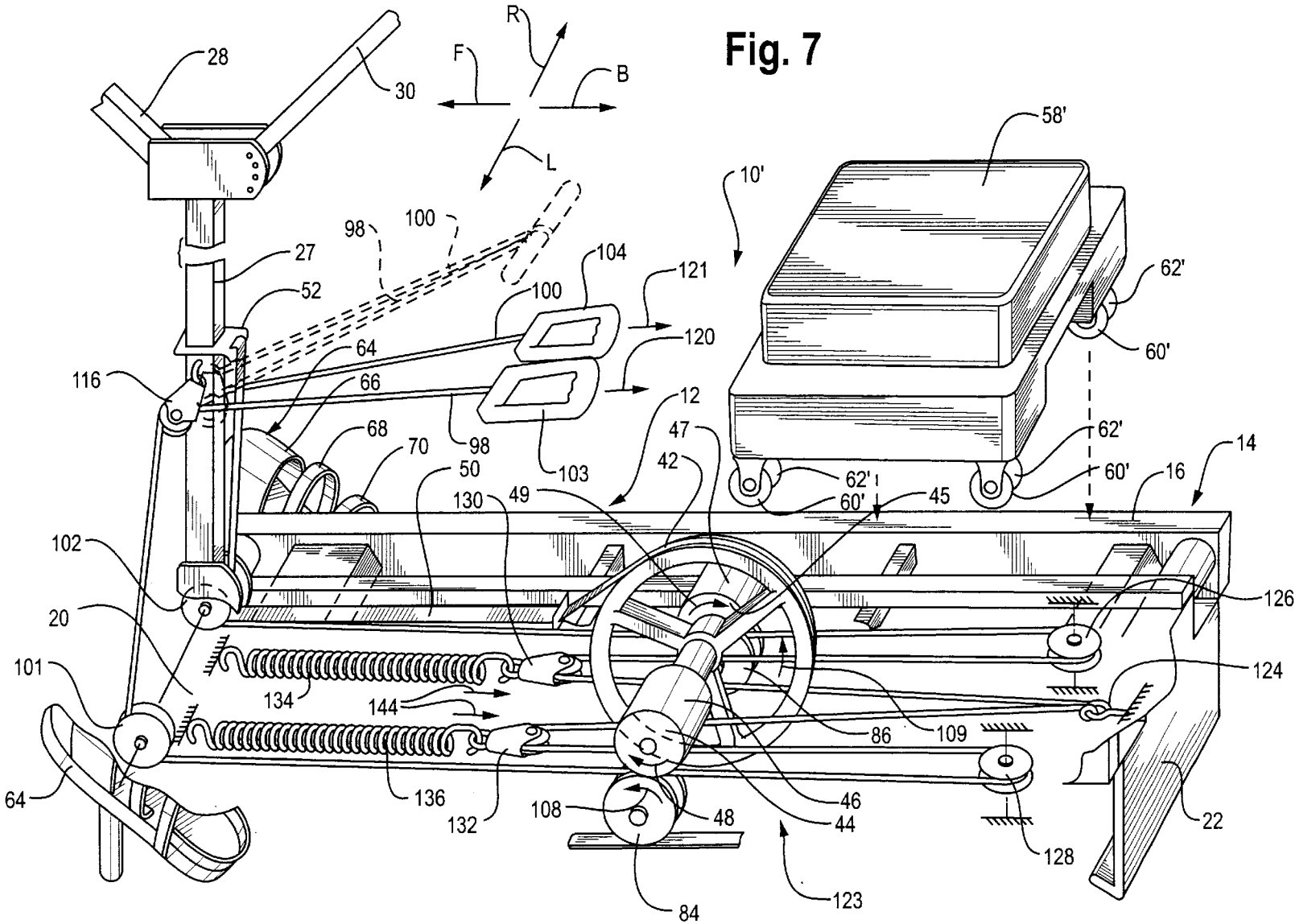
FIG. 7 is a perspective fragmentary view of the attachment according to the second embodiment depicting the pulley system associated with the coupling device.

Referring now to FIG. 7, additional pulleys 116,118 have been added to permit the handles 103,104 to be pulled in a substantially horizontal direction as indicated by arrows 120,121. Handles 103,104 may be replaced with a single handle unit 122 to which cables 98 and 100 are attached.

FIG. 7 also illustrates a cable and pulley system 123 for providing the resistance associated with the flywheel 42 to a user's arm movement during a rowing exercise. The cable and pulley system 123 includes an eyelet 124 attached to the rear member 22, pulleys 126,128 attached to the frame 14 near the rear member 22, and pulleys 130,132 attached to the front member 20 via tension springs 134,136.

Cable 98 extends from handle 103 around pulleys 116 and 101 and wraps around the spool 84. The cable 98 then extends from the spool 84 around pulleys 128 and 132, and is secured to eyelet 124. Similarly, cable 100 extends from handle 104 around pulleys 118 and 102 and wraps around the spool 86. The cable 100 then extends from the spool 86 around pulleys 126 and 130, and is secured to eyelet 124.

Operation of the exercise apparatus 10' as a rowing machine is as follows. A user sits in the seat 58' and places his/her feet in foot supports 64. The user grasps and pulls handles 103,104 (or handle 122) and pulls them in the direction indicated by arrows 120,121. Movement in this direction causes spools 84,86 to rotate in the direction indicated by arrows 108,109, which in turn causes rollers 44,45 to rotate in the direction indicated by arrows 48,49, which in turn provides the resistance associated with the flywheel 42 to a user's arm movement during a rowing exercise. Pulling on the handles 103,104 in the direction indicated by arrows 120,121 also causes pulleys 130,132 to move in the direction indicated by arrows 144 against the force of springs 134,136, further providing resistance to user's arm movement during a rowing exercise.

Figures 8, 9:
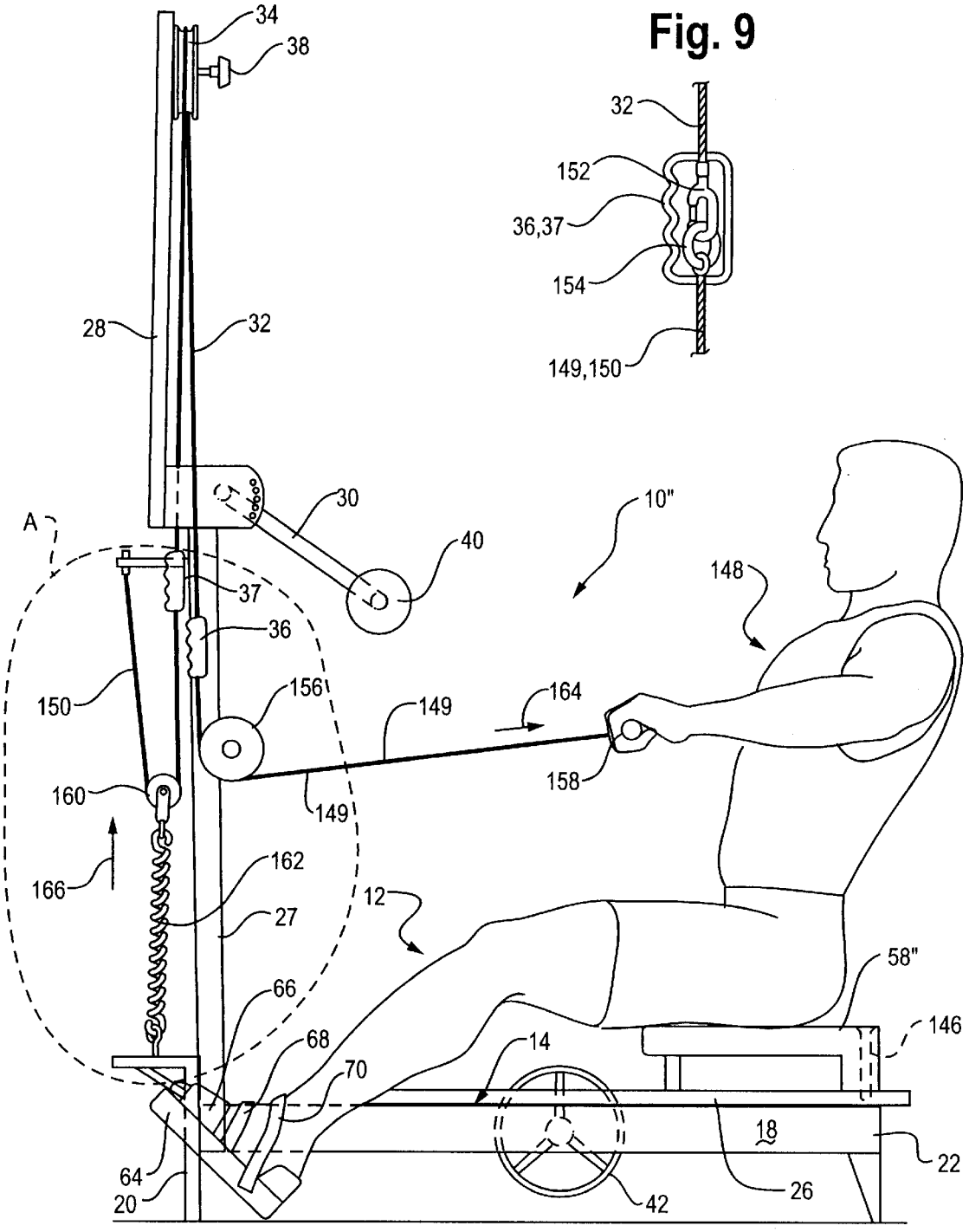
FIG. 8 is a side view of the exercise apparatus according to a third embodiment of the present invention including a tensioning system for providing resistance to a user's arm movement during a rowing exercise.
FIG. 9 is an enlarged side fragmentary view of the dotted portion labeled A in FIG. 8.

Referring now to FIG. 8, a third embodiment of the exercise apparatus of the present invention is shown generally at 10" with like elements indicated with the same reference numbers and elements requiring modification indicated with a double prime ("). In this third embodiment, the seat 58" is fixedly attached to the skis 24,26 via screws 146 or other conventional attachment means. Accordingly, when a user, shown generally at 148, utilizes the exercise apparatus 10" to effectuate a rowing exercise, the resistance associated with the flywheel 42 is provided to the user's 148 legs by movement of the seat 58" and skis 24,26. The cable and pulley arrangement used during a cross-country ski simulation exercise is applied to the user's 148 arm movement during a rowing exercise as follows.

The pivotable post 28 is pivoted to a substantially vertical position as shown in FIG. 8. Cable extenders 149,150 are affixed to the distal ends of the cable 32. One such method of connecting the cable extenders 149,150 is depicted in FIG. 9. The distal ends of the cable 32 include a clasp hook 152 which hooks onto an eyelet 154 attached to one of the distal ends of the cable extenders 149,150. The clasp hook 152 and eyelet 154 are hidden by the handles 36,37 for aesthetic purposes. Other conventional methods of connecting the cable extenders 149,150 to the cable 32 may be implemented with the present invention without departing from the spirit and scope thereof.

Cable extender 149 extends from the handle 36 around pulley 156 attached to the vertical post 27 to a handle 158 at its other distal end. Cable extender 150 extends from the handle 37 around a pulley 160 and is secured to the vertical post 27. The pulley 160 is attached to the frame 14 via a tension spring 162. It should be noted that the pulley 160 may be attached to the vertical post 27, via tension spring 162, without departing from the spirit and scope of the present invention.

Pulling on the handle 158 in the direction indicated by arrow 164 effectuates movement of the pulley 160 in an upward direction indicated by arrow 166 against the force of the tension spring 162. Accordingly, resistance is provided to the user's 148 arm movement during a rowing exercise by the tension spring 162 and the drum pulley 34, the resistance of which is adjusted via the tension adjust knob 38. Thus, the user 148 is capable of exercising both his/her arms and legs during a rowing exercise.

It should be noted that the seat 58 (shown in FIG. 3) may be utilized with the exercise apparatus 10" (shown in FIG. 8) should the user 148 wish to exercise only his/her arms.

Figure 10:
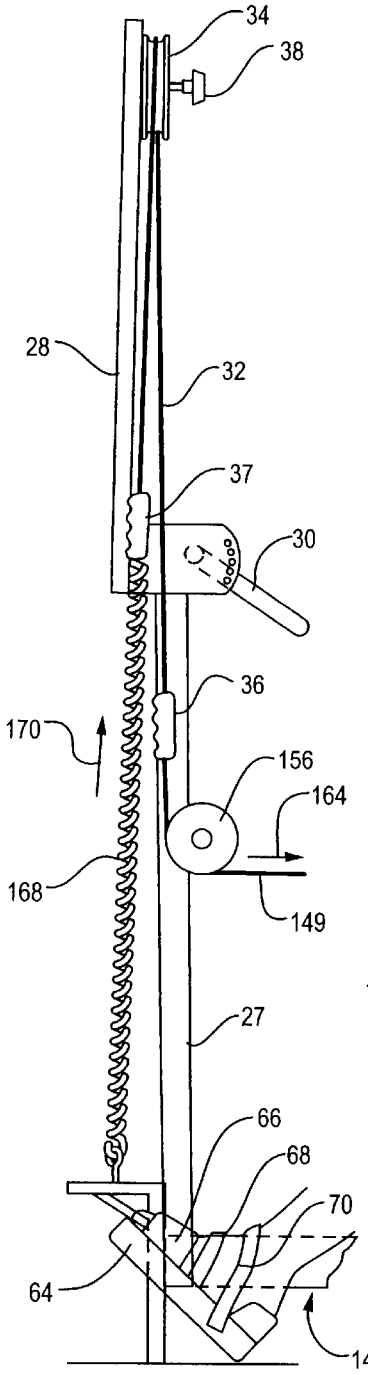
FIG. 10 is a side view of an alternative configuration of the tensioning system shown in FIG. 8.
Figure 11:
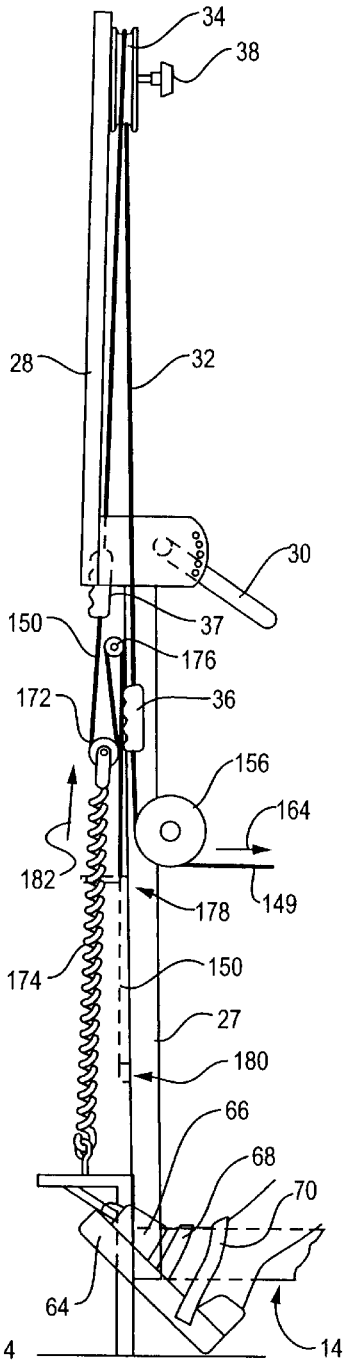
FIG. 11 is a side view of still another alternative configuration of the tensioning system shown in FIG. 8.
Figure 12:
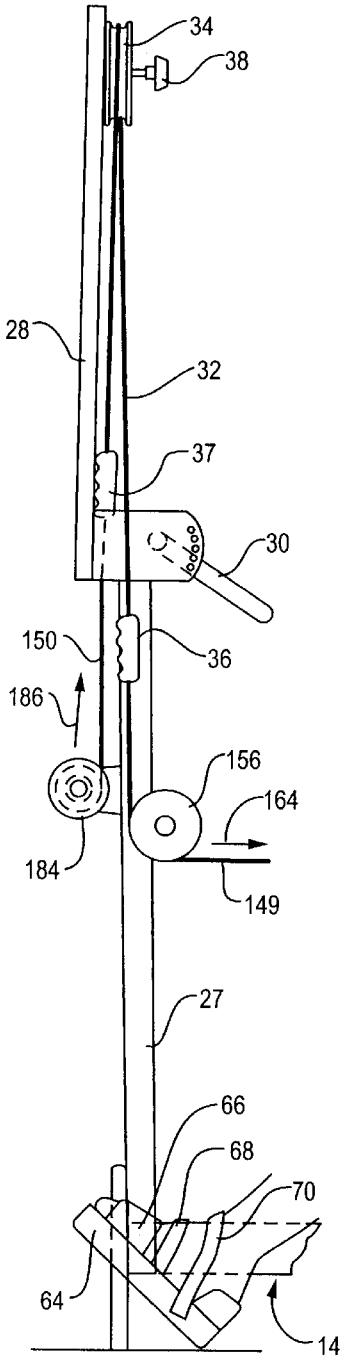
FIG. 12 is a side view of yet another alternative configuration of the tensioning system as shown in FIG. 8.

FIGS. 10–12 depict variations to the arm resistance structure indicated generally at A in FIG. 8. In FIG. 10, the cable extender 150, pulley 160 and spring 162 in FIG. 8 are replaced with a tension spring 168 connected between the handle 37 and the frame 14. Alternatively, the tension spring 168 may be connected between the handle 37 and the vertical post 27. Movement of the cable extender 149 in the direction indicated by arrow 164 stretches the tension spring 168 in an upward direction indicated by arrow 170, thus applying resistance, in addition to the resistance provided by drum pulley 34, to the user's 148 arm movement during a rowing exercise.

In FIG. 11, the cable extender 150 extends from the handle 37 around a pulley 172 which is connected to the frame 14 via a tension spring 174. Alternatively, the tension spring 174 may be connected between the pulley 172 and the vertical post 27. The cable extender 150 then extends from pulley 172 around a pulley 176 attached to the frame 14, and is then attached at 178 to the tension spring 174. It should be noted that the cable extender 150 alternatively may be attached at 180 to the vertical post 27.

Movement of the cable extender 149 in the direction indicated by arrow 164 causes pulley 172 to move in an upward direction indicated by arrow 182 in opposition to the force of the tension spring 174. Thus, the tension associated with the tension spring 174, in addition to the resistance provided by the drum pulley 34, provides resistance to the user's 148 arm movement during a rowing exercise.

In FIG. 12, the cable extender 150 extends from the handle 37 to a constant spring force assembly 184 attached to the vertical post 27. Movement of the cable extender 149 in the direction indicated by arrow 164 effectuates movement of the cable extender 150 in the direction indicated by arrow 186 in opposition to the spring force provided by the constant spring force assembly 184, which tends to bias the cable extender 150 against movement in the direction indicated by arrow 186. Thus, the constant spring force assembly 184, in addition to the resistance associated with the drum pulley 34, provides resistance to the user's 148 arm movement during a rowing exercise.

Figure 13:
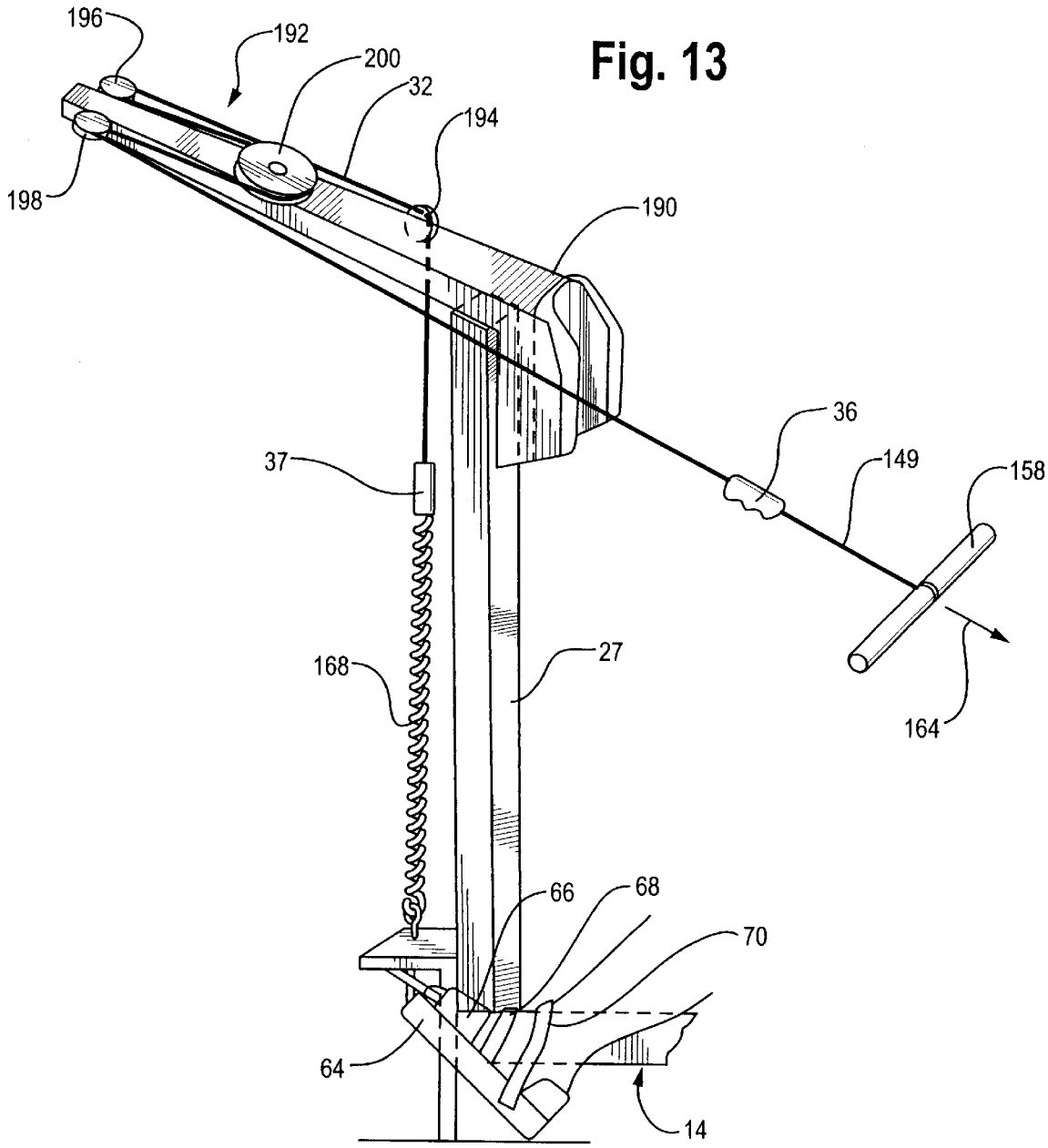
FIG. 13 is a perspective view of an alternative configuration of the arm resistance assembly shown in FIG. 10.

FIG. 13 depicts an alternative embodiment of the arm resistance structure shown in FIG. 8. The pivotable post 28 and drum pulley 34 of FIG. 8 have been replaced with a non-pivoting rod assembly 190 and a pulley assembly 192. The pulley assembly 192 includes pulleys 194, 196 and 198, and flywheel 200, all of which are attached to the non-pivoting rod assembly 190 and which cooperate with the cable 32 to provide resistance to a user's arm movement.

More specifically, the cable 32 extends from handle 37 around pulley 194, from pulley 194 around pulley 196, from pulley 196 around flywheel 200, from flywheel 200 around pulley 198, and from pulley 198 to handle 36. Movement of the handle 158 in the direction shown by arrow 164 stretches the tension spring 168 in an upward direction indicated by arrow 170 and provides resistance to a user's arm movement during a rowing exercise via flywheel 200 and tension spring 168.

It should be noted that the tension spring 168, shown in FIG. 13, may be replaced with the various other assemblies depicted in FIGS. 8, 11 and 12 without departing from the spirit and scope of the present invention.

Figure 14:
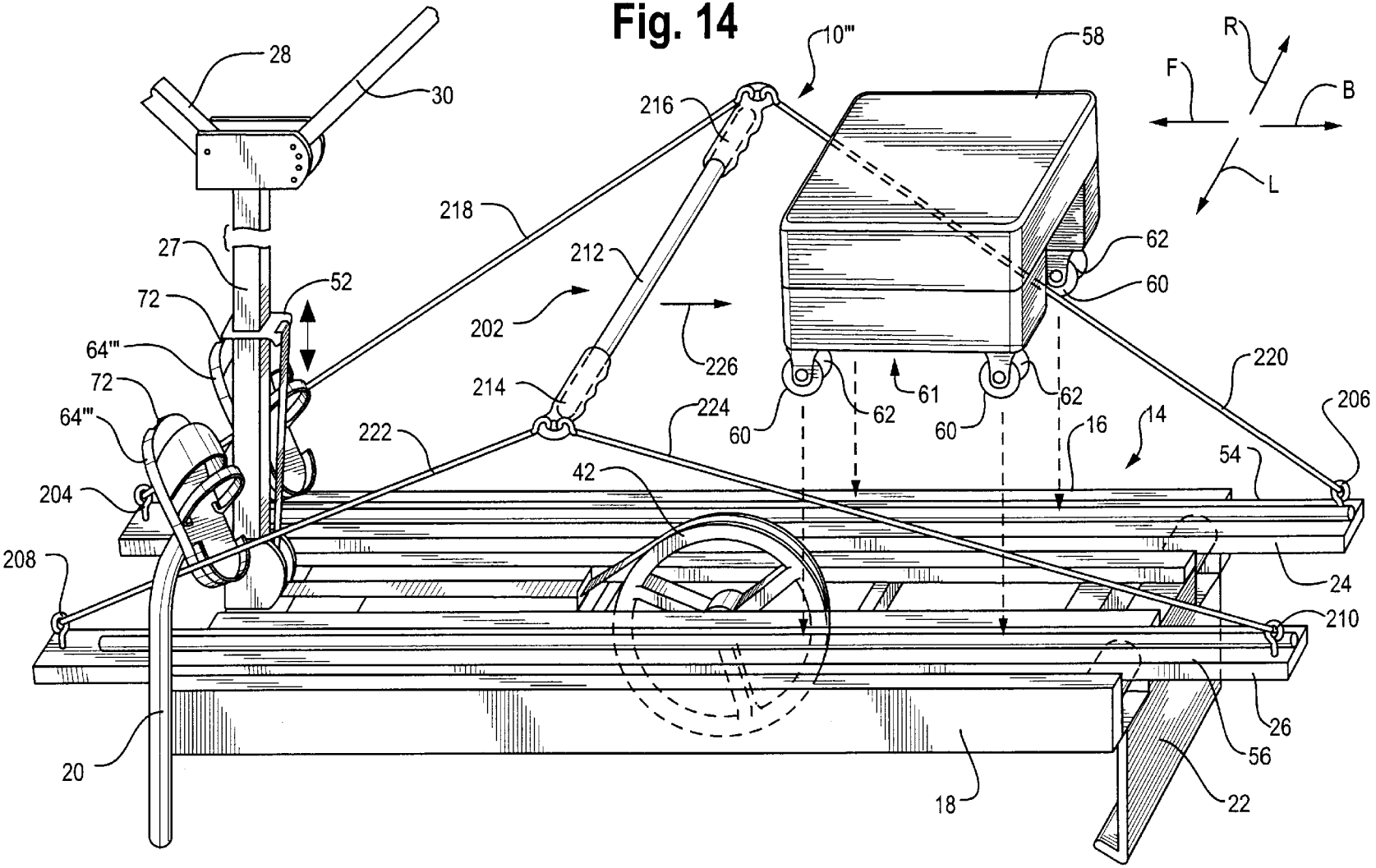
FIG. 14 is a perspective view of an alternative configuration of the attachment shown in FIG. 1.

FIG. 14 depicts an alternative configuration, shown generally 10''', of the exercise apparatus 10 shown in FIG. 1 with like elements indicated with the same reference numbers and elements requiring slight modification indicated with a triple prime (''').As shown in FIG. 14, the rowing oars 74,76 have been removed and replaced with a cable and handle system shown generally at 202.

System 202 includes eyelets 204,206,208,210 attached to the distal ends of the skis 24,26, and a handle 212 generally graspable by a user at areas 214 and 216. Cables 218 and 220 connect handle area 216 to eyelets 204 and 206, respectively, on ski 24. Similarly, cables 222 and 224 connect handle area 214 to eyelets 208 and 210, respectively, on ski 26.

In operation, a user sits in the seat 58 and places his/her feet in foot supports 64''' which are attached to the front member 20. The user then grasps the handle areas 214,216 and effectuates a rowing motion moving handle in a rearward direction shown generally by arrow 226. Movement of the handle 212 in the direction shown by arrow 226 effectuates movement of the skis 24,26, via cables 218,222, in a backward or rearward direction, which in turn couples the resistance associated with the flywheel 42 to a user's arm movement during a rowing exercise.

While the handle 212 is depicted as a unitary member in FIG. 14, it should be noted that the handle 212 may include separate handle members attached to cables 218,220 and 222,224, respectively, thus allowing a user to effectuate reciprocating movement of the skis 24,26.

Figure 15:
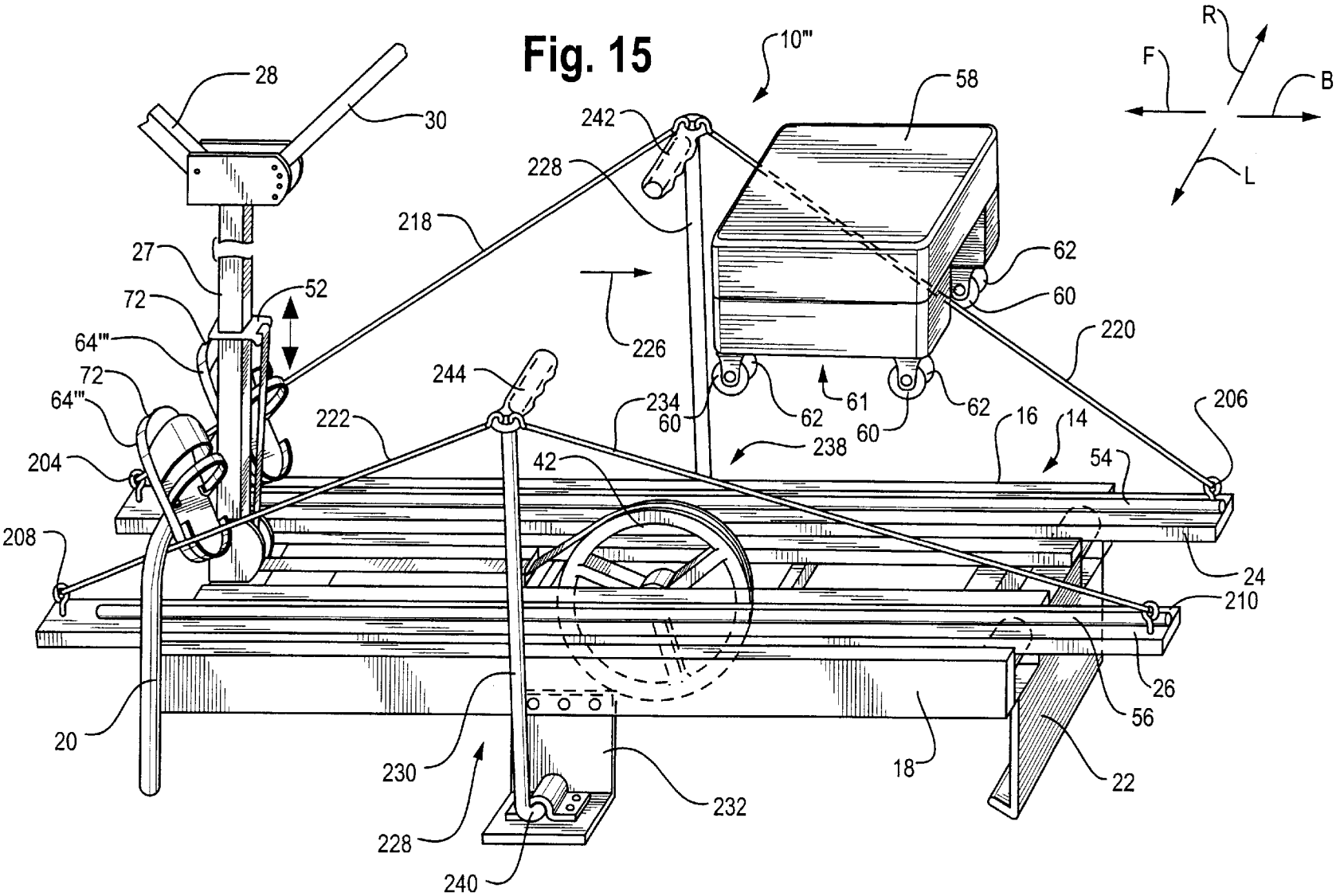
FIG. 15 is a perspective view of an alternative configuration of the attachment shown in FIG. 14.

FIG. 15 depicts an alternative configuration of the exercise apparatus 10''' of FIG. 14. The handle 212 (shown in FIG. 14) has been replaced with a pair of rowing oars 228,230. The frame 14 includes a pair of oar support members 232 (only one shown in FIG. 15) extending laterally from side members 16,18. The pair of rowing oars 228,230 are pivotally attached to the support members 232 at their lower ends 238,240. The rowing oars 228,230 include handle areas 242,244 at their other end, the handle areas 242,244 being graspable by a user to perform a rowing exercise when sitting in the seat 58.

Cables 218 and 220 connect rowing oar 228 to eyelets 204 and 206, respectively, on ski 24. Similarly, cables 222 and 224 connect rowing oar 230 to eyelets 208 and 210, respectively, on ski 26.

In operation, a user sits in the seat 58 and places his/her feet in the foot supports 64'''. The user then grasps the handle areas 242,244 of the rowing oars 228,230 and effectuates a rowing motion, either moving the oars 228,230 in the same or reciprocating directions. Movement of the oars 228,230 effectuates movement of the skis 24,26, via cables 218,220 and 222,224, in either rearward or forward directions depending on the direction of movement of the respective rowing oar 228,230. Movement of the skis 24,26 in turn couples the resistance associated with the flywheel 42 to a user's arm movement during a rowing exercise.

It should be noted that while the rowing oars 228,230 are depicted in FIG. 15 as only pivoting in forward and rearward directions, other types of pivotal attachments, such as, but not limited to, universal pivoting of the rowing oars 228,230, is also contemplated.

While the invention has been described with particular reference to the drawings, it should be understood that various modifications may be made without departing form the spirit and scope of the present invention.

What is claimed is:

1. An exercise apparatus interchangeably usable in a plurality of configurations, said exercise apparatus comprising:

a frame;

a pair of skis slidably mounted on the frame to move in forward and rearward directions;

each of the skis having an upper surface;

first means mounted on the frame for providing resistance to the pair of skis during at least one of forward and rearward movement;

a seat removably mounted for guided sliding movement along the upper surfaces of the pair of skis; and second means mounted to the frame for coupling the first means to provide resistance to a user's arm movement during a rowing exercise.

2. The exercise apparatus of claim 1 and further comprising:

a track mounted on each of the skis for movement therewith;

means for operatively mounting the seat on the track for guided sliding movement with respect to the track, and a pair of foot supports removably mountable on the pair of skis for use during a skiing exercise and on the frame for use with the pair of rowing oars and seat.

3. The exercise apparatus of claim 1 wherein the second means further comprises handle means for grasping by a user while sitting on the seat; and a plurality of cables removably coupling the handle means to the pair of skis, the handle means with movement of the pair of skis.

4. The exercise apparatus of claim 3 and further comprising a pair of foot supports removably mountable on the pair of skis for use during a skiing exercise and on the frame for use with the oars and the seat during a rowing exercise.

5. An attachment for interchangeably converting a ski simulating machine into a rowing machine, the ski simulating machine having a frame, the frame for receiving a pair of skis movement in forward and rearward directions, and resistance means mounted on the frame for providing resistance to the a pair of skis during at least one of the forward and rearward movement, the attachment comprising, a pair of skis, A seat having downwardly extending support members, the supporting the seat on the upper surfaces of said pair of skis, guide means on said pair of skis for retaining the support members for movement of the seat along the upper surfaces of said pair of skis, glide means on the support members for providing gliding movement of the seat along the upper surfaces of said pair of skis.

6. The attachment of claim 5 wherein the guide means further comprises a track on each of the pair of skis for movement therewith, track engagement means on the glide means for maintaining the support members in engagement with the track for movement along the upper surfaces of the pair of skis.

7. The attachment of claim 6 wherein the glide means are wheels.

8. The attachment of claim 7 wherein the track and the track engagement means further comprise a groove in one of the wheels and the pair of skis.

9. The attachment of claim 5 and further including handle means for grasping by a user sitting on the seat, coupling means connected to the handle means and the resistance means for providing resistance to movement of the handle means in at least one direction.

10. The attachment of claim 9 wherein the coupling means attaches to the pair of skis.

11. The attachment of claim 9 and further comprising a pair of rowing oars removably attachable to the frame.

12. The attachment means of claim 11 wherein the coupling means is a plurality of cables extending between the handle means and the pair of skis.

* * * * *